United States Patent [19]

Washington

[11] 4,214,508

[45] Jul. 29, 1980

[54] METHOD AND APPARATUS FOR MAKING CIGARETTE FILTERS OF FILAMENTARY MATERIAL

[75] Inventor: James M. Washington, Richmond, Va.

[73] Assignee: Philip Morris Incorporated, New York, N.Y.

[21] Appl. No.: 841,804

[22] Filed: Oct. 13, 1977

[51] Int. Cl.[2] ..... A24C 5/50; D02J 1/22

[52] U.S. Cl. ..... 93/1 C; 28/243; 264/167

[58] Field of Search ..... 28/243; 93/1 C, 77 FT; 264/167, 290 R, 290 J, 290 N; 425/76; 131/261 B

[56] References Cited

U.S. PATENT DOCUMENTS

| | | | |
|---|---|---|---|
| 1,898,085 | 2/1933 | Dreyfus et al. | 264/167 |
| 2,038,722 | 4/1936 | Dreyfus et al. | 264/167 |
| 2,847,703 | 8/1958 | Schrenk et al. | 264/167 |
| 3,394,429 | 7/1968 | Nakagawa et al. | 264/167 X |
| 3,561,045 | 2/1971 | Heffernan | 264/167 X |
| 3,837,264 | 9/1974 | Sexstone | 93/1 C |
| 3,844,200 | 10/1974 | Sexstone | 93/1 C |
| 3,847,064 | 11/1974 | Berger | 93/1 C |
| 3,884,741 | 5/1975 | Sexstone | 93/1 C X |
| 3,910,166 | 10/1975 | Sexstone | 93/1 C |

*Primary Examiner*—James F. Coan
*Attorney, Agent, or Firm*—Watson, Leavenworth, Kelton & Taggart

[57] ABSTRACT

In the course of continuous transport of filamentary material, mutually spaced portions thereof are selectively stretched, yielding articles having a longitudinal profile varying in filamentary material volume and of essentially constant filament density per unit volume. In producing cigarette filters, additive material is applied to the stretched material portions.

21 Claims, 20 Drawing Figures

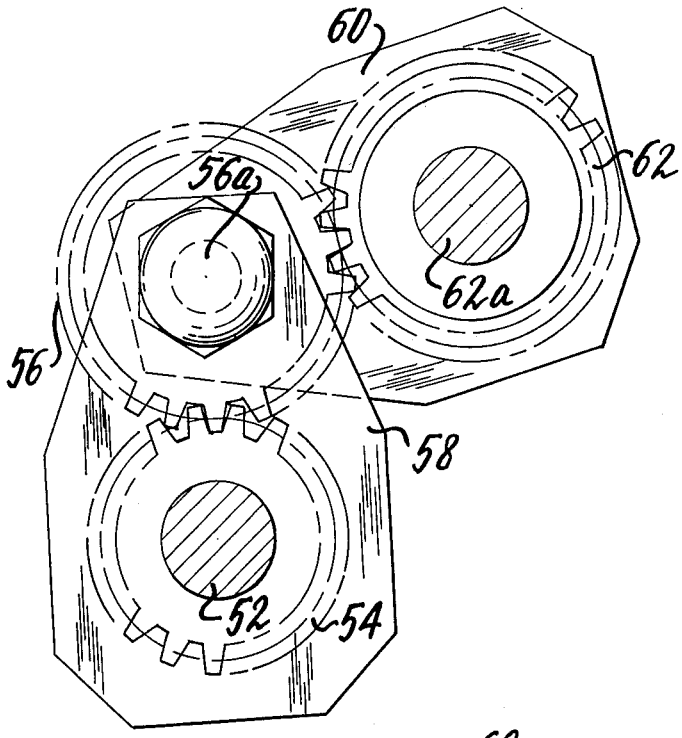
FIG. 7
FIG. 8
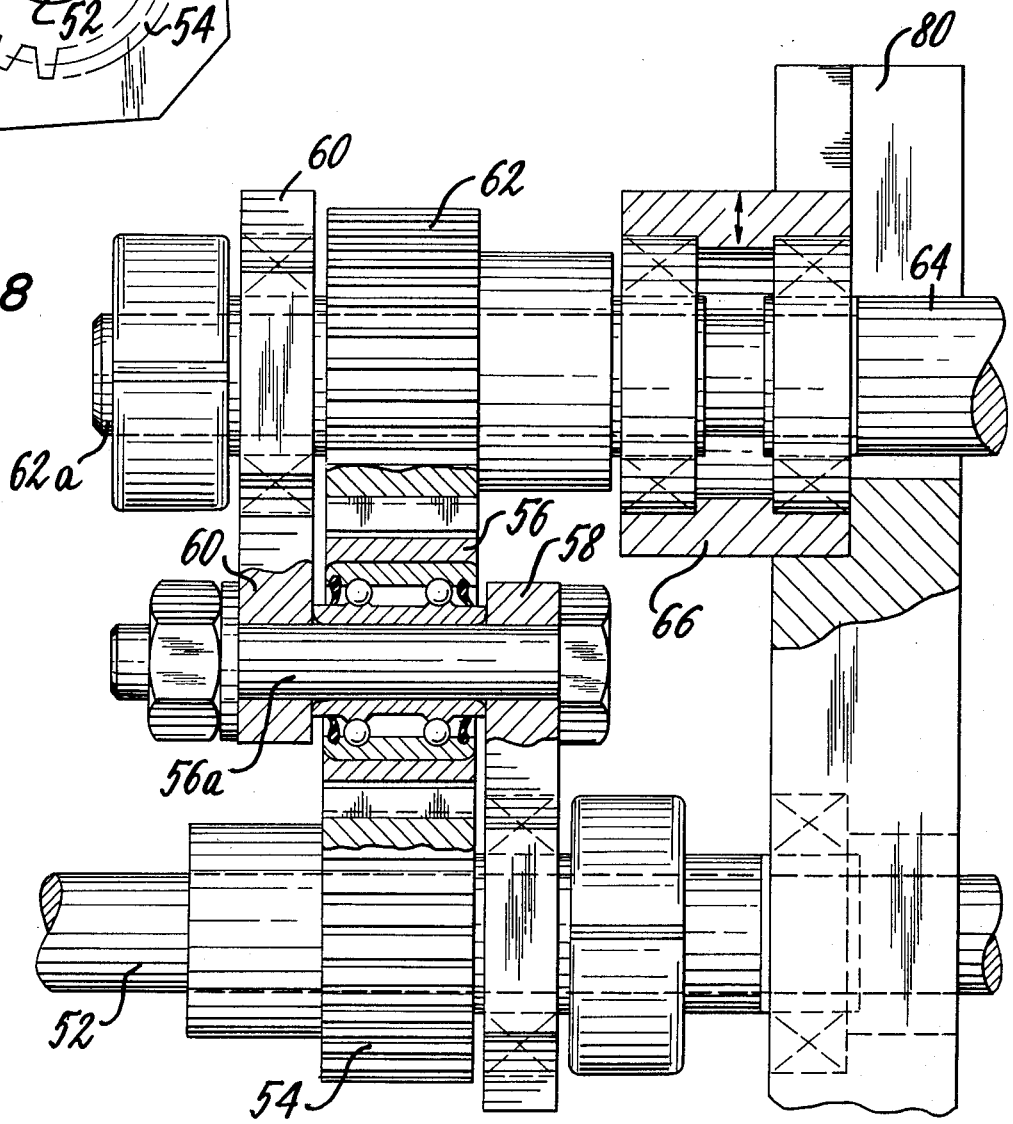

METHOD AND APPARATUS FOR MAKING CIGARETTE FILTERS OF FILAMENTARY MATERIAL

FIELD OF THE INVENTION

This invention relates to methods and apparatus for processing continuous filamentary material and articles comprised thereof and, more particularly, to the processing of cigarette filter tow for the making of cigarette filters of type including additive material.

BACKGROUND OF THE INVENTION

Prior art techniques for the manufacture of cigarette filters containing additive material by processing of continuous tow have involved the compression of rod-shaped tow to form a depression therein suited for the receipt of additive material. Typically, the tow is processed by long-known apparatus into rod configuration and tow compressing apparatus operates upon longitudinally spaced portions of the continuously advanced tow rod. Upon application of the additive material to the rod depressions, the rod is suitably closed about the material and further operated upon by wrapping, sealing and cutting units to form finished cigarette filters. Such prior art practices are set forth in U.S. Pat. Nos. 3,837,264, 3,844,200, 3,884,741, 3,910,166 and 3,847,064.

The above-discussed technique has advantage in various respects over other known practices in which individual filter plugs are separated from one another by spaces for receipt of additive material, such practice being generally referred to as plug-space-plug filter making. Thus, the first-discussed practice avoids the need for pre-forming individual filter plugs and maintaining precise spacing therebetween in the course of conveyance to additive material dispensing units. A disadvantage exists, however, in the first-discussed practice based on its characteristic tow compression. By reason thereof, the filament density per unit volume of the tow longitudinally of the finished filter element changes from nominal density in filter element portions not containing additive material, i.e., uncompressed regions, to undesirably increased density in those filter element portions corresponding to tow compression regions. Possible results are an undesirable increase of draw resistance in the vicinity of the additive material and undesired increase in plug firmness or in rod diameter in such filter portions.

It is an object of the present invention to provide improved cigarette filters containing additive material and improved methods and apparatus for processing of continuous filter tow to produce such filters.

It is a more general object of the invention to provide elongate articles, comprised of a plurality of continuous filaments and characterized by longitudinal variation in filamentary material volume accompanied by substantially constant filament density per unit volume throughout their longitudinal extent, and methods and apparatus for making the same.

In attaining the foregoing and other objects, the invention provides a practice whereby elongate filamentary material is advanced continuously longitudinally between mutually spaced issue and take-up locations and wherein longitudinally spaced extents of such material in transit between the locations are subjected to stretching while other extents of such material in transit are maintained in unstretched condition throughout such transit. The respective extents of the stretched and unstretched filamentary material extents are preselectable, whereby any desired longitudinal extent of lessened filamentary material volume may be provided in such continuously advancing tow while filament density per unit cross-section is maintained substantially constant.

In cigarette filter manufacture in accordance with the invention, low filament volume portions of the tow are selected in longitudinal extent corresponding to the extent of filter elements in which additive material is to be included. Accordingly, resistance to draw is generally uniform throughout the finished filter element and the additive material does not give rise to increased rod firmness or diameter.

The foregoing and other objects and features of the invention will be evident from the following detailed description of preferred practices and embodiments and from the drawings wherein like reference numerals identify like parts throughout.

DESCRIPTION OF THE DRAWINGS

FIG. 7 is a partial rear elevational view of the FIG. 5 apparatus.

FIG. 8 is a partial side elevational view of the FIG. 5 apparatus, sectioned and broken away to show detail.

DETAILED DESCRIPTION OF PREFERRED EMBODIMENTS AND PRACTICES

Figure 1:
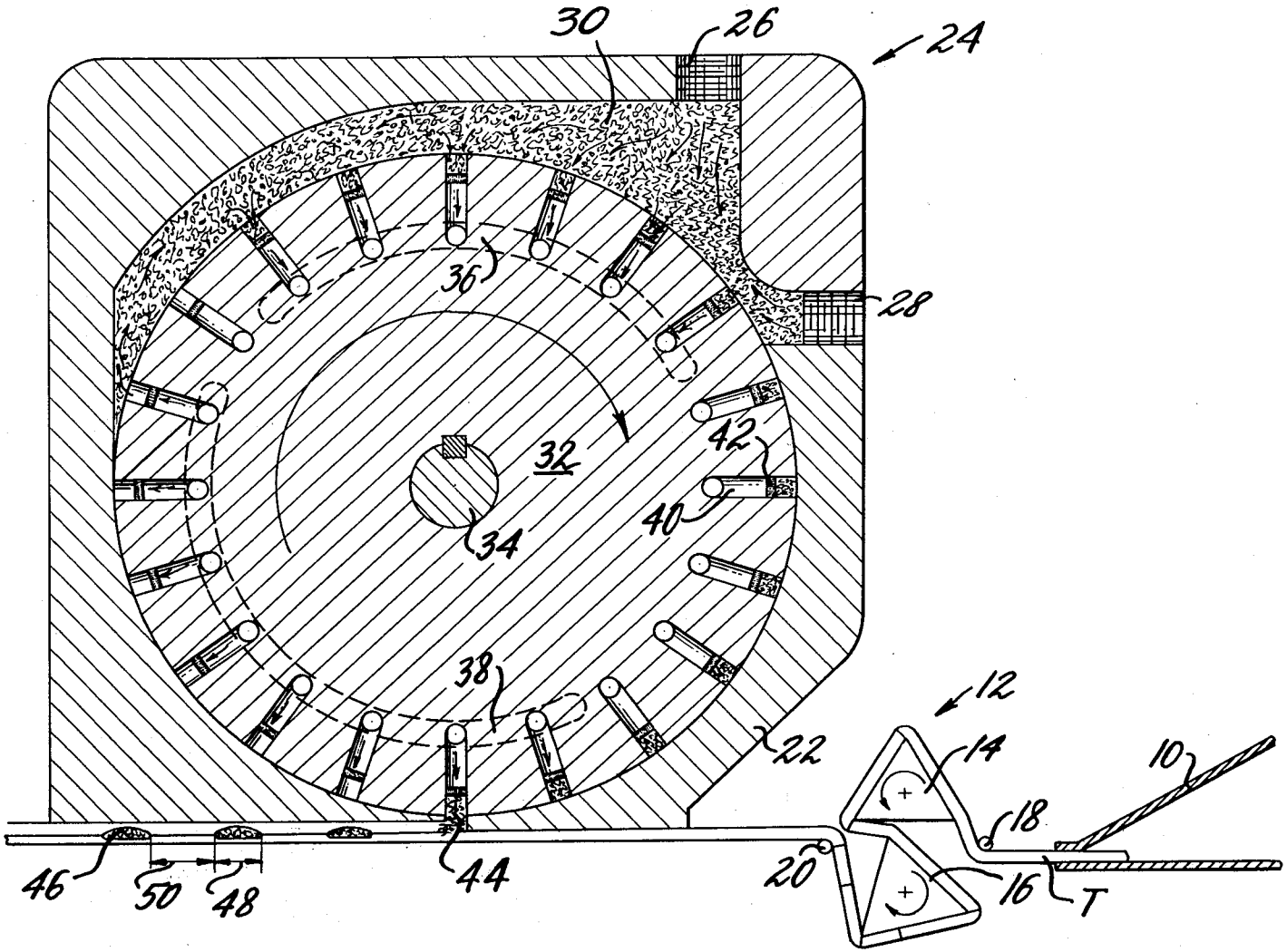
FIG. 1 is a schematic illustration of tow processing apparatus according with the invention shown in conjunction with cigarette filter-making apparatus.

Referring to FIG. 1, tow T is formed into elongated continuous rod configuration by forming horn 10 of well-known commercial usage and is led in such configuration into stretching apparatus 12, comprised in the FIG. 1 embodiment of opposed cams 14 and 16, each of triangular shape and rotated in mutually opposite senses as indicated by the arrows. For discussion purposes, tensioning rod or roller 18 shall be considered to be a tow issue location and tensioning rod or roller 20 shall be considered to be a tow take-up location.

Tow advancing longitudinally leftwardly of rod 20 passes beneath portion 22 of dispensing unit 24. Unit 24 includes ports 26 and 28, respectively for inserting additive material and fluidizing medium to hopper 30. Collector wheel 32 is keyed to drive shaft 34 for rotation as indicated within unit 24. Negatively-pressurized conduit 36 is fixedly disposed with respect to wheel 32 as is positively-pressurized conduit 38, suitable structure for this purpose being set forth in U.S. Pat. No. 4,005,668, commonly assigned herewith. As shown in more detail in such U.S. Pat. No. 4,005,668,, collector wheel 32 includes slots 40 extending radially outwardly from a radial location in registry with ducts 36 and 38 to the collector wheel periphery, air permeable discs 42 being fixedly disposed in the slots. As the slots communicate with duct 36, additive material is drawn from hopper 30 into the slot portion radially outward of discs 42 and the thus-filled slots are transported to dispensing station 44, in the course of which movement the slots communicate with duct 38 for pressurized dispensing of their contents onto tow T. Dispensed material resident on tow T is indicated at 46. As is to be appreciated, the specific structure of unit 24 does not form a part of the present invention and alternate material dispensing apparatus may of course be employed. The subject invention concerns itself, rather, with processing of tow T to control tow filament volume and density over tow portions 48, to which additive material 46 is applied, and adjacent tow portions 50, to which additive material is not applied.

Figure 2:
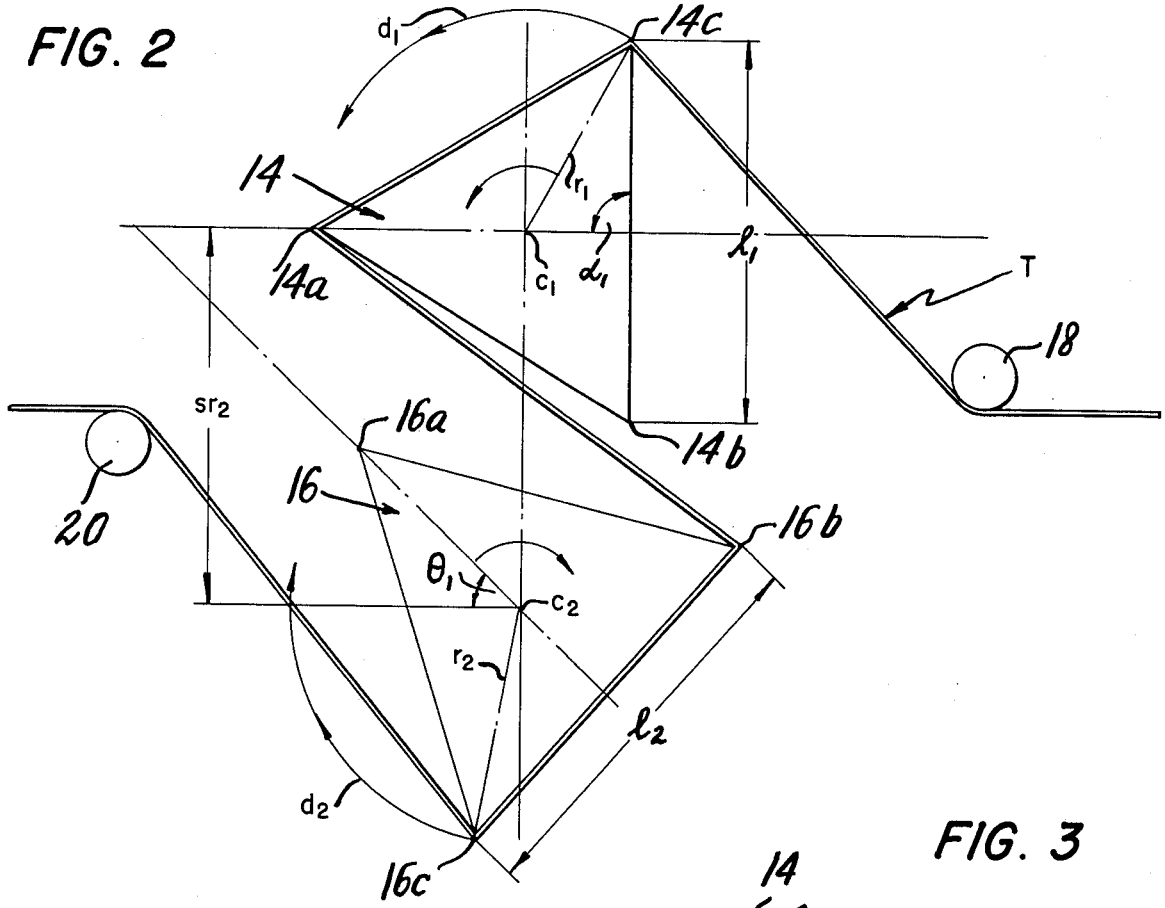
FIG. 2 is a showing of the FIG. 1 tow processing apparatus with explanatory geometric references indicated thereon.

Turning to FIG. 2, various geometrical aspects of the preferred structure for unit 12 are indicated. Cam 14 is rotated about its center $c_1$ and has turning radius $r_1$ and its three sides are of equal length $l_1$. The cam tips are identified as 14*a*, 14*b* and 14*c*. For positioning reference purposes, the cam side extending between cam tips 14*b* and 14*c* forms an angle $\alpha_1$ with the horizontal.

Figure 6:
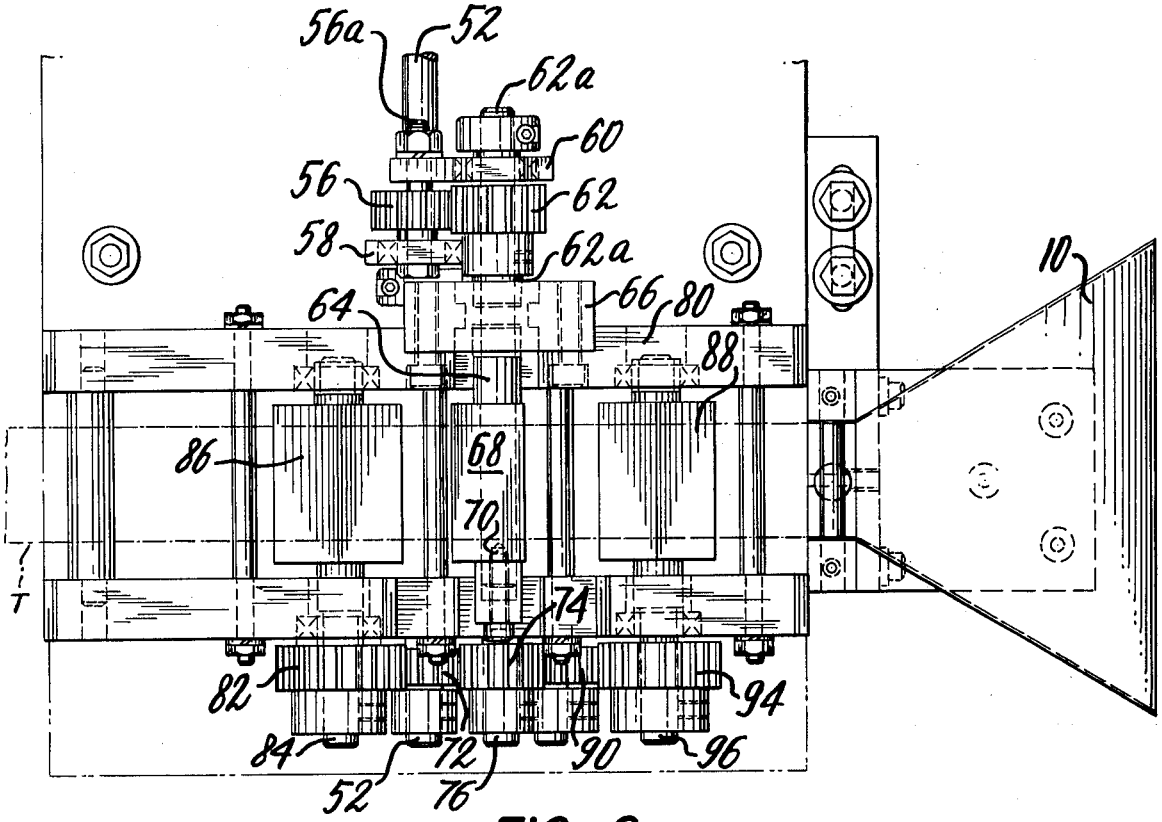
FIG. 6 is a plan view of the FIG. 5 apparatus.
Figure 5:
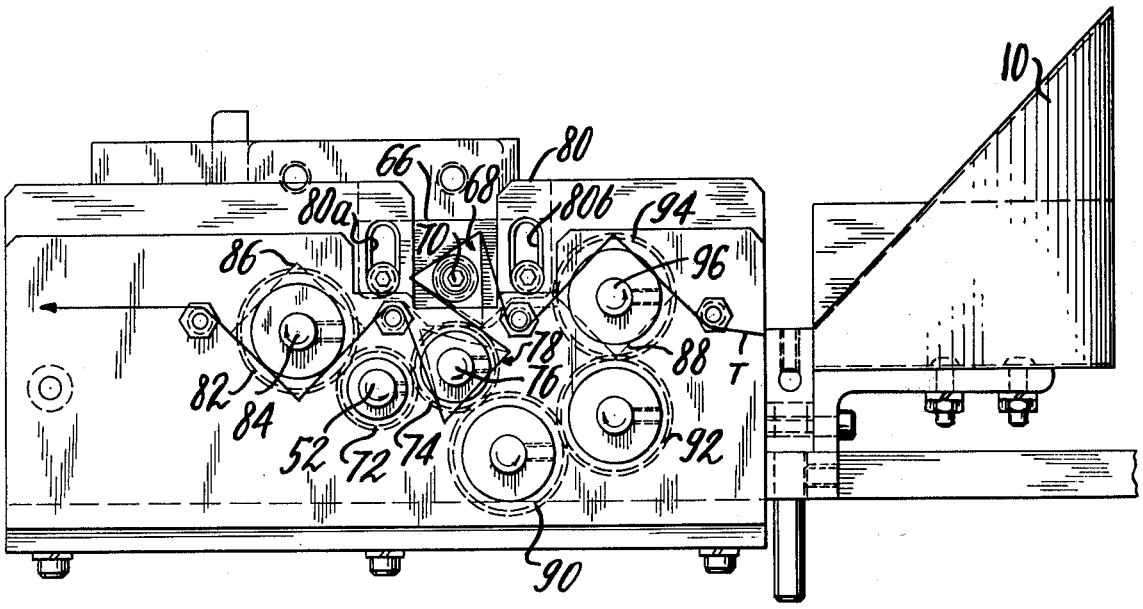
FIG. 5 is a front elevational view of a preferred apparatus embodiment of the invention.

Cam 16 has center $c_2$, turning radius $r_2$ and cam tips 16*a*, 16*b* and 16*c*. Each side of cam 16 is of length $l_2$, which exceeds length $l_1$ of cam 14 to effect the stretching of tow. By structure shown and discussed hereinafter in connection with FIGS. 5 and 6, cams 14 and 16 are rotated in respective opposite senses at the same rotational speed with centers $c_1$ and $c_2$ on a common vertical axis and mutually spaced by distance $sr_2$. For reference purposes, a line extending between cam tip 16*a* and center $c_2$ of cam 16 is identified as forming angle $\theta_1$ with the horizontal.

As is known in the prior art, tractable material may be stretched over its length by use of differently-sized, successively disposed transport rollers. In FIG. 2, consider, for purposes of explanation, cam tips 14*c* and 16*c* to be points on the periphery of such prior art rollers and to be displaced through distances $d_1$ and $d_2$ on roller rotation through a 90° angle. Distance $d_1$ defines the longitudinal measure of tow issued by rod 18 and distance $d_2$ the longitudinal measure of tow collected by rod 20. Since $r_2$ exceeds $r_1$, $d_2$ exceeds $d_1$ and the tow is accordingly stretched. Such stretching occurs uniformly over the entire length of material transported between the issue and collecting locations where such prior art rollers are employed. In contrast, the FIG. 2 apparatus enables stretching over selective portions of such transported material, as will be understood from FIGS. 3 and 4(*a*) through 4(*m*), now jointly discussed.

In FIG. 4(*a*), cams 14 and 16 are in their FIG. 2 orientation and two inter-cam tip distances are noted, $d_{c1}$ and $d_{p1}$. Distance $d_{c1}$ is defined as the distance between the leading cam tip of cam 14 engaging tow T, namely, cam tip 14*a*, and the tip of cam 16 closest thereto, namely, cam tip 16*a*. Distance $d_{p1}$ is defined as the distance between such leading operative cam tip of cam 14 and the lagging operative cam tip of cam 16, namely, cam tip 16*b*. Commencement of tow stretching will occur as distance $d_p$ less distance $d_c$ becomes equal to distance $l_1$, i.e., the common length of the sides of cam 14.

In FIGS. 4(*b*) through 4(*m*), each of cams 14 and 16 is rotated stepwise through 10° angular movements. Thus, in FIG. 4(*b*), cam 14 has been rotated counterclockwise by 10° from its FIG. 4(*a*) orientation and cam 16 has been rotated 10° clockwise from its FIG. 4(*a*) orientation. The above-noted inter-cam tip distance condition for stretching is observed not to exist in FIG. 4(*b*) and is still absent in the course of further cam rotation shown in FIG. 4(*c*). Stretching commences at a rotational juncture between the showings of FIGS. 4(*c*) and 4(*d*) at which juncture the stretching condition is met. Stretching of the portion of tow T between cam tips 14*a* and 16*a* continues, once commenced, through the succeeding orientations, with maximum stretching occuring at approximately the orientational disposition of the cams shown in FIG. 4(*k*). As rotation of the cams progresses further into the FIG. 4(*l*) orientation, it will be observed that the retention of portion $P_a$ and $P_b$ [FIG. 4(*g*)] of tow T, respectively by cam tips 14*a* and 14*c* of cam 14 and cam tips 16*a* and 16*b* of cam 16, diminishes and goes to nil as tow T releases from the side of cam between cam tips 14*a* and 14*c* as fully occurs in the orientation shown in FIG. 4(*m*). Such retention or capture of tow portions $P_a$ and $P_b$ is enabled by the relatively sharp angular relation between the cam sides whereby the cam tips effectively restrain from relative longitudinal movement opposed ends of each of portions $P_a$ and $P_b$. Such capture aspect is operative as the distance stretching condition is met.

Figure 3:
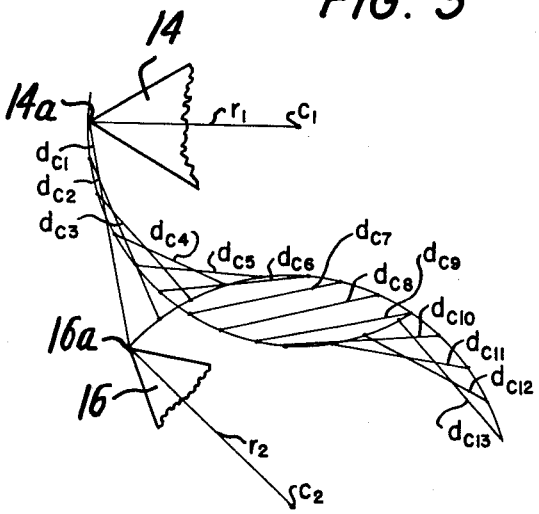
FIG. 3 is a geometric illustration of progressive distance change between adjacent cam tips 14*a* and 16*a* of the FIG. 1 tow processing apparatus in the course of cam rotation.
Figure 4M:
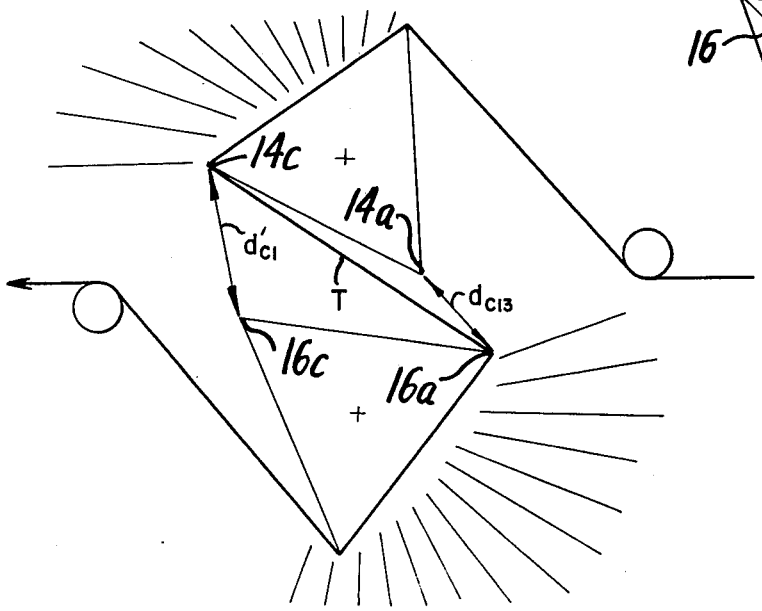
FIGS. 4(*a*)–4(*m*) illustrate the respective orientations of cams 14 and 16 in the course of 120° rotation thereof.
Figure 4A:
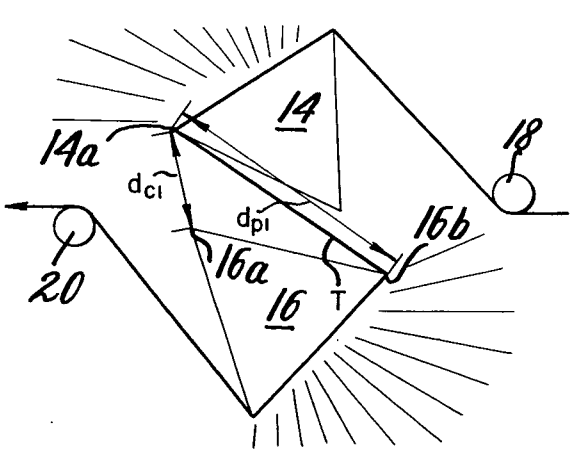
Figure 4B:
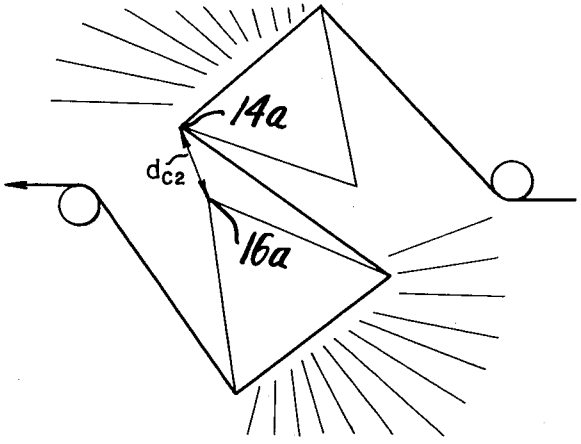
Figure 4C:
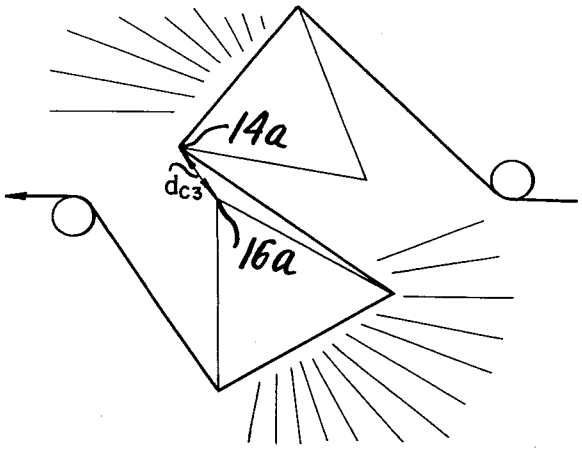
Figure 4D:
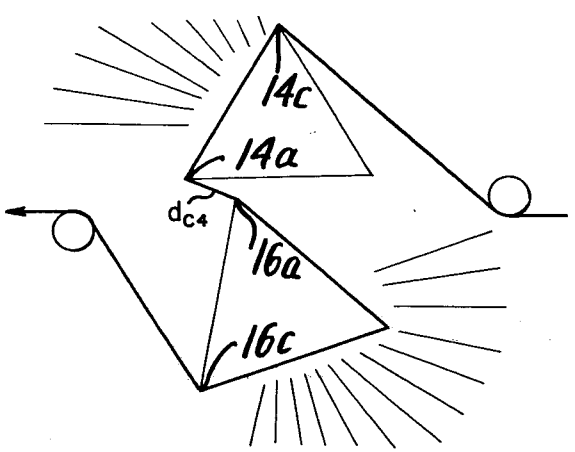
Figure 4E:
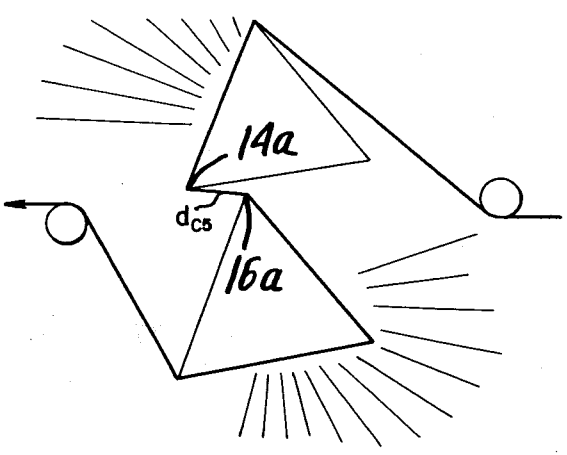
Figure 4F:
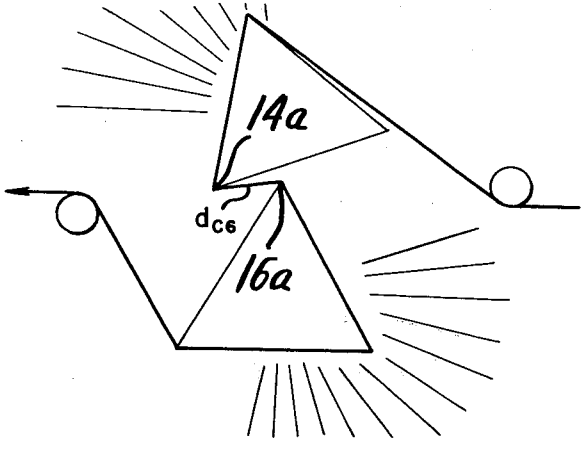
Figure 4G:
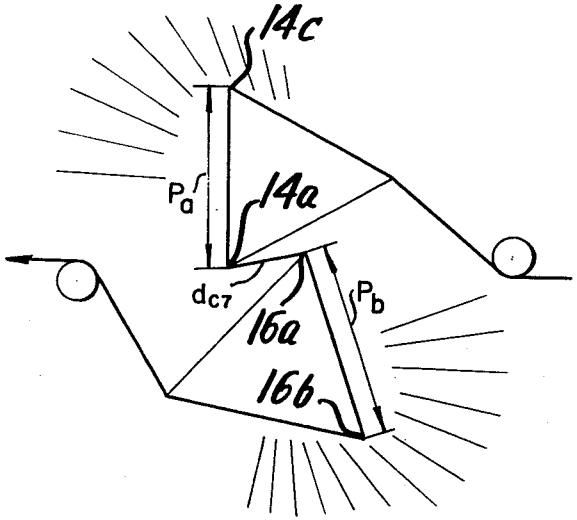
Figure 4H:
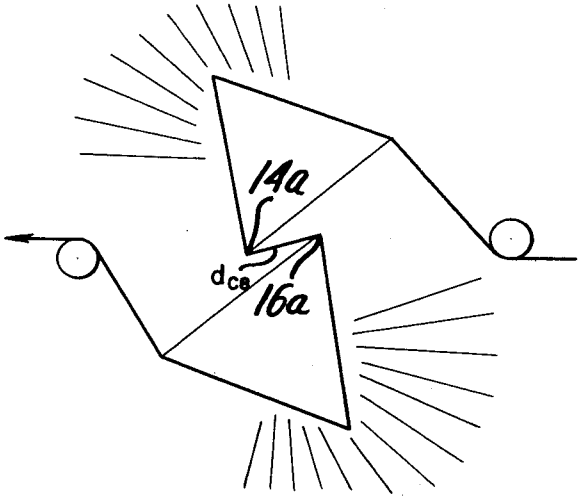
Figure 4I:
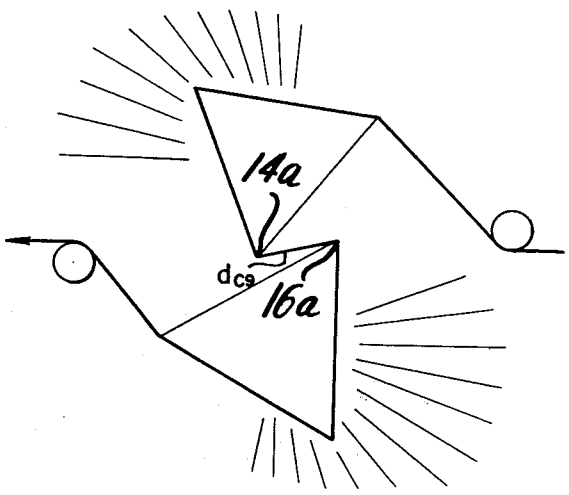
Figure 4J:
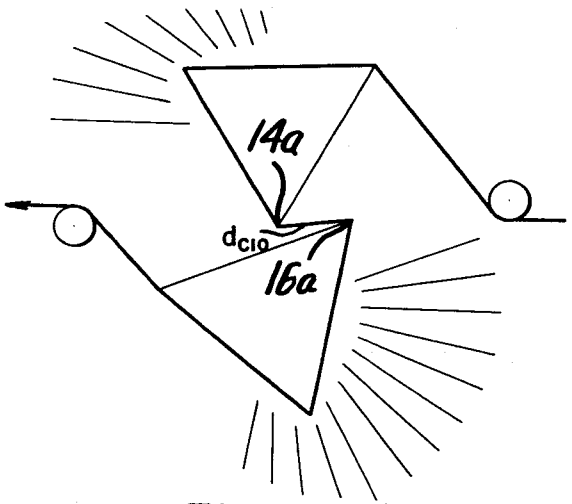
Figure 4K:
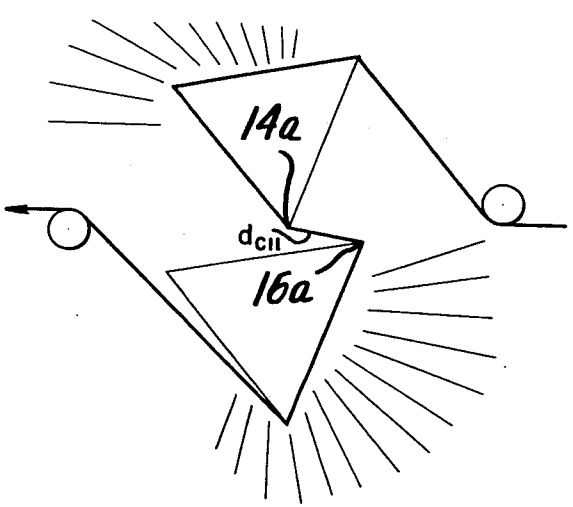
Figure 4L:
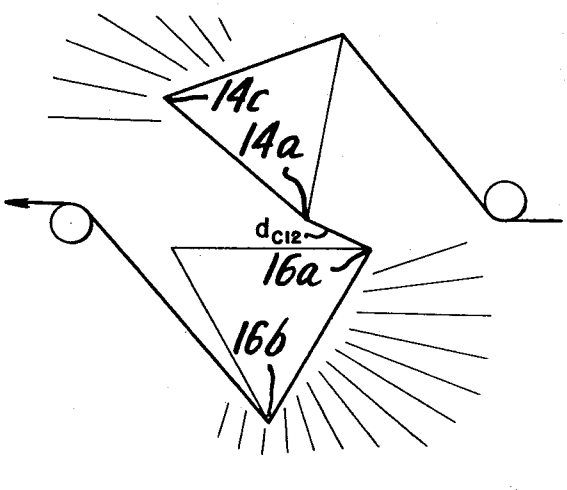

In FIG. 3, the respective orientations and extents of $d_{c1}$ through $d_{c13}$ are shown. Comparison thereof with corresponding $d_p$ measurements will indicate further that stretching commences between $d_{c3}$ and $d_{c4}$ and is discontinued between $d_{c12}$ and $d_{c13}$. Thus, FIG. 3 depicts the zone of tow stretching under the influence of cam tips 14*a* and 16*a*. Like stretching zones apply successively for stretching between cam tips 14*c* and 16*c*, as will commence on further cam orientation from the FIG. 4(*m*) showing, and thereafter for stretching between cam tips 14*b* and 16*b*. Since all stretching operations are identical, lengths of stretched portions are uniform as are lengths of unstretched portions.

Referring to FIG. 4(*g*), the leading portion of tow T, i.e., closest to cam tip 16*a*, is stretched, whereas the successive portion of tow T leading rearwardly to cam tip 14*c* is unstretched. The respective extents of such stretched and unstretched portions may be varied by variation of the geometric parameters shown in FIG. 2, i.e., $\alpha_1$, $\theta_1$, $r_1$, $r_2$ and a ratio S, defined as $sr_2/r_2$, $sr_2$ being the distance between cam centers $c_1$ and $c_2$. Preselection of the extents of stretched and unstretched portions of tow is accommodated by the following analytical definitions of $d_c$ and $d_p$, wherein the angle $\beta$ is of measure equal to the difference between angles $\alpha$ and $\theta$:

$$dc = l_2/\sqrt{3}[(f\sin\alpha - \sin\beta)^2 + (S - f\cos\alpha - \cos\beta)^2]^{\frac{1}{2}} \quad (1)$$

and $$d_p = l_2/\sqrt{3}[f\sin\alpha - \sin(\beta - 120)]^2 + [S - f\cos\alpha - \cos(\beta - 120)^2]^{\frac{1}{2}} \quad (2)$$

where f equals $r_1/r_2$.

In an illustrative practice using the FIG. 2 stretching apparatus, with initial cam orientation $\alpha = 90°$, $\theta = 48°$ and with S=1.6405, f=0.92, $l_2$=25 mm. and $l_1$=23 mm., the following tabulation of values applies.

| $\alpha$ | $\beta$ | $(\beta-120)$ | $d_c$ | $d_p$ | $d_p-d_c$ |
|---|---|---|---|---|---|
| 90° | 42° | −78° | 13.449mm. | 34.325mm. | 20.876mm. |
| 80 | 32 | −88 | 10.649 | 34.524 | 23.900 |
| 70 | 22 | −98 | 9.117 | 34.115 | 24.998 |
| 69 | 21 | −99 | 9.046 | 34.042 | 24.996 |
| 68 | 20 | −100 | 8.990 | 33.964 | 24.973 |
| 65 | 17 | −103 | 8.902 | 33.696 | 24.794 |

-continued

| $\alpha$ | $\beta$ | $(\beta-120)$ | $d_c$ | $d_p$ | $d_p-d_c$ |
|---|---|---|---|---|---|
| 60 | 12 | −108 | 8.987 | 33.146 | 24.159 |
| 50 | 2 | −118 | 9.695 | 31.712 | 22.016 |
| 40 | −8 | −128 | 10.574 | 29.964 | 19.390 |
| 30 | −18 | −138 | 11.207 | 28.111 | 16.904 |
| 20 | −28 | −148 | 11.423 | 26.421 | 14.999 |
| 10 | −38 | −158 | 11.219 | 25.194 | 13.975 |
| 0 | −48 | −168 | 10.752 | 24.701 | 13.949 |
| −10 | −58 | −178 | 10.364 | 25.091 | 14.727 |
| −20 | −68 | −188 | 10.570 | 26.322 | 15.752 |

Retention of tow on cam sides with $d_p-d_c$ equal to $l_1$, i.e., commencement of stretching, is noted to occur between $\alpha=80°$ and $\alpha=70°$. Maximum stretching is noted between $\alpha=20°$ and $\alpha=10°$ and conclusion of stretching (release) is noted at about $\alpha=-10°$. With the foregoing parameters, the respective lengths of stretch and successive unstretched tow portions are 11.4 mm. and 13.6 mm. This data is included in the table below as Example 1. In Examples 2 and 3, $\theta$ is increased successively with other parameters as in Example 1. These practices give successively increased measures of stretched lengths and corresponding decreased measures of unstretched lengths. In Example 4, the Example 2 parameter values apply, except that $_1$ and f are decreased. As compared with Example 2 results, the Example 4 practice decreases stretched length and increases unstretched length. In Example 5, all Example 2 parameter values apply except S is decreased, with consequent increase in stretched length and decrease in unstretched length from that of Example 2.

| Example | $l_1$ mm | $l_2$ mm | $\Theta$ deg. | S | f | Stretched Length (final) mm | Un-Stretched Length (final) mm |
|---|---|---|---|---|---|---|---|
| 1 | 23 | 25 | 48 | 1.6405 | 0.92 | 11.4 | 13.6 |
| 2 | 23 | 25 | 60 | 1.6405 | 0.92 | 13.9 | 11.1 |
| 3 | 23 | 25 | 75 | 1.6405 | 0.92 | 17.0 | 8.0 |
| 4 | 21 | 25 | 60 | 1.6405 | 0.84 | 13.5 | 11.5 |
| 5 | 23 | 25 | 60 | 1.5000 | 0.92 | 14.1 | 10.9 |

Referring to FIGS. 5-8, drive shaft 52 has gear 54 fixed thereto in engagement with idler gear 56 (FIGS. 7, 8). Shaft 56a of gear 56 has gear support brackets 58 and 60 secured thereto as indicated, with bracket 60 supporting gear 62. Shaft 62a of gear 62 drives shaft 64 through coupler 66, shaft 64 having upper triangular cam 68 releasably secured thereto by fitting 70 for purposes discussed below.

At its end opposite gear 54, drive shaft 52 has gear 72 fixed thereto in engagement with gear 74. Gear 74 is secured to shaft 76 which supports lower triangular cam 78. As drive shaft 52 is driven counterclockwise (FIG. 5), gear 72 imparts clockwise rotation to gear 74 and hence lower cam 78. Conversely, gears 54, 56 and 62 impart counterclockwise rotation to upper cam 68.

For purposes of varying the spacing between cams 78 and 68, the fittings on idler gear shaft 56a are released and bracket 60 is rotated with respect to bracket 58. This action displaces gear 62 and cam 68, coupler 66 being likewise displaced in housing tracks 80a and 80b into new position. On desired spacing of the cams, the shaft 56a fittings are again secured. At this juncture, fitting 70 is released and cam 68 rotated on shaft 64 to reassume its desired orientation angle.

Gear 82 is in engagement with gear 72 and is keyed to shaft 84 which supports output prismatic shaft 86. Input prismatic shaft 88 is rotated by gear 72 through intermediate gears 74, 90, 92, gear 94 being keyed to shaft 96 supporting prismatic shaft 88. In this embodiment, the prismatic shafts have square cross-section and are rotated, by gear ratio selection at a rotational speed of three-quarters the rotational speed of the triangular cams. The extent of each flat face of prismatic shaft 86 in its direction of rotation is equal to the length of the flat faces of triangular cam 78 in its direction of rotation. The extent of each flat face of prismatic shaft 88 in its direction of rotation is equal to the length of the flat faces of triangular cam 68 in its direction of rotation. The addition of the prismatic shafts to the stretching apparatus serves to maintain tension in tow T without further appreciably stretching it.

While the invention has been disclosed by way of particularly described practices and apparatus resulting in the provision of specifically structured articles of manufacture with or without additive material, the invention contemplates variation in such practices, apparatus and manufacture. Thus, modification of the particularly shown triangular cam version of the apparatus and accompanying practice can be undertaken providing stretched and non-stretched portions of filamentary material. Further, while the invention contemplates principally the addition of granular additive material in its cigarette filter aspects, any additive material may be used as desired. In respect of the general article of manufacture without additive material, the same lends itself to such practices as variable dye take-up in the production of novelty yarns and the like. Accordingly, it is to be appreciated that the particularly disclosed practices, apparatus and products are intended in a descriptive and not in a limiting sense. The true spirit and scope of the invention is set forth in the following claims.

What is claimed is:

1. A method for providing an article of manufacture comprised of elongate filamentary material, including the steps of:

(a) continuously longitudinally advancing said material through an issue location;

(b) continuously longitudinally advancing said material through a take-up location spaced from said issue location; and (c) while continuously transporting said material from said issue location to said take-up location, longitudinally stretching selected mutually spaced first portions of said material and simultaneously retaining second portions of said material longitudinally successive to such first portions to prevent stretching of said second portions thereof.

2. The method claimed in claim 1 wherein said step (c) is practiced in manner providing uniformity in the longitudinal extent of each said first portion of said material.

3. The method claimed in claim 2 wherein said step (c) is practiced in further manner by providing uniformity in the longitudinal extents of said second portions of said material.

4. The method claimed in claim 1 wherein the retaining of said second portions in step (c) is practiced in part by restraining from relative longitudinal movemend opposed ends of said second portions of said material by imparting a relatively sharp angular bend at each of said ends in the course of such continuous transport thereof.

5. The method claimed in claim 4 wherein said step (c) is practiced in manner providing uniformity in the longitudinal extent of each said first portion of said material.

6. The method claimed in claim 5 wherein said step (c) is practiced in further manner by providing uniformity in the longitudinal extents of said second portions of said material.

7. The method claimed in claim 1 including the further step of applying additive matter to such material first portions following such stretching thereof.

8. A method for making filter elements comprised of elongate filamentary material including the steps of:

(a) continuously forming said material into an elongate rod configuration;

(b) continuously longitudinally advancing such formed material through an issue location;

(c) continuously longitudinally advancing said formed material through a take-up location spaced from said issue location;

(d) while continuously transporting said material from said issue location to said take-up location, longitudinally stretching selected mutually spaced first portions of said material and simultaneously retaining second portions of said material longitudinally successive to such first portions to prevent stretching of said second portions thereof; and (e) applying additive material to said material first portions following such stretching thereof.

9. The method claimed in claim 8 wherein said step (d) is practiced in manner providing uniformity in the longitudinal extent of each said first portion of said material.

10. The method claimed in claim 9 wherein said step (d) is practiced in further manner by providing uniformity in the longitudinal extents of said second portions of said material.

11. The method claimed in claim 8 wherein the retaining of said second portions in step (d) is practiced in part by restraining from relative longitudinal movement opposed ends of said second portions of said material by imparting a relatively sharp angular bend at each of said ends in the course of such continuous transport thereof.

12. The method claimed in claim 11 wherein said step (c) is practiced in manner providing uniformity in the longitudinal extent of each said first portion of said material.

13. The method claimed in claim 12 wherein said step (c) is practiced in further manner by providing uniformity in the longitudinal extents of said second portions of said material.

14. Apparatus for use in providing an article of manufacture of elongate filamentary material comprising first and second means for successively receiving and for continuously transporting said material, each said first and second means having facility for selectively restraining opposed ends of longitudinally spaced portions of such received material from relative longitudinal movement in the course of such continuous transport thereof, and third means for moving said first and second means in respective opposite senses, thereby effecting such transport and longitudinal stretching of the extent of said material between said spaced portions thereof.

15. The apparatus claimed in claim 14 including means supporting said first and second means for rotation, said third means imparting respective opposite sense rotational movement to said first and second means.

16. The apparatus claimed in claim 15 wherein each of said first and second means defines a common succession of flat surfaces in the direction of rotation thereof, said flat surfaces of said first means being of extent in such direction of rotation of said first means less than corresponding extents of said flat surfaces of said second means.

17. The apparatus claimed in claim 16 wherein said third means imparts like rotational speed to said first and second means.

18. The apparatus claimed in claim 16 wherein said first and second means each defines a succession of three such flat surfaces equally angularly orientated relative to one another.

19. The apparatus claimed in claim 14 further including fourth means for supplying said material to said first means and fifth means for receiving said material from said second means, said fourth and fifth means being coactive to maintain tension in said material.

20. The apparatus claimed in claim 19 wherein each of said first and second means defines a common succession of flat surfaces in the direction of rotation thereof, said flat surfaces of said first means being of extent in such direction of rotation of said first means less than corresponding extents of said flat surfaces of said second means, and wherein each of said fourth and fifth means defines a further succession of flat surfaces in directions of rotation thereof, said further succession being greater in number than said common succession.

21. The apparatus claimed in claim 15 wherein said third means includes further means for varying the distance between the centers of rotation of said first and second means.

* * * * *